US007472452B2

(12) United States Patent
Junell

(10) Patent No.: US 7,472,452 B2
(45) Date of Patent: Jan. 6, 2009

(54) DOOR THRESHOLD VACUUM

(76) Inventor: Corey Junell, 1701 FM 1504, Wills Point, TX (US) 75169

( * ) Notice: Subject to any disclaimer, the term of this patent is extended or adjusted under 35 U.S.C. 154(b) by 57 days.

(21) Appl. No.: 11/420,194

(22) Filed: May 24, 2006

(65) Prior Publication Data

US 2007/0271723 A1 Nov. 29, 2007

(51) Int. Cl.
*A47L 5/38* (2006.01)

(52) U.S. Cl. ..... 15/310; 15/301

(58) Field of Classification Search ..... 15/301, 15/310, 319, 326, 339
See application file for complete search history.

(56) References Cited

U.S. PATENT DOCUMENTS

| | | | | | |
|---|---|---|---|---|---|
| 2,152,756 | A | * | 4/1939 | Billmyre | 55/429 |
| 2,895,159 | A | * | 7/1959 | Ostrow | 15/311 |
| 3,165,773 | A | * | 1/1965 | Palpacelli | 15/310 |
| 3,411,174 | A | * | 11/1968 | Jordan | 15/310 |
| 3,445,875 | A | * | 5/1969 | Bohannon | 15/36 |
| 3,786,531 | A | * | 1/1974 | Borg | 15/310 |
| 4,024,599 | A | | 5/1977 | Gamboa | |
| 4,027,355 | A | | 6/1977 | Mead et al. | |
| 4,233,707 | A | * | 11/1980 | Leblanc | 15/311 |
| 4,551,879 | A | | 11/1985 | Ray | |
| 4,706,326 | A | * | 11/1987 | Romani | 15/314 |
| 4,835,409 | A | * | 5/1989 | Bhagwat et al. | 307/64 |
| 5,205,013 | A | * | 4/1993 | Lopes | 15/301 |
| 5,588,175 | A | * | 12/1996 | Zahner | 15/310 |
| 5,655,253 | A | * | 8/1997 | Nevin et al. | 15/310 |
| 6,044,519 | A | * | 4/2000 | Hendrix | 15/319 |
| 6,067,688 | A | | 5/2000 | West | |
| 6,105,201 | A | * | 8/2000 | Min | 15/302 |
| 6,199,244 | B1 | * | 3/2001 | Hilgers et al. | 15/339 |
| 6,406,549 | B1 | * | 6/2002 | Berg et al. | 134/1 |
| 6,482,252 | B1 | * | 11/2002 | Conrad et al. | 96/57 |
| 6,532,618 | B2 | * | 3/2003 | Koch | 15/310 |
| 6,704,015 | B1 | | 3/2004 | Bovarnick et al. | |
| 2004/0177467 | A1 | * | 9/2004 | Jones et al. | 15/310 |
| 2005/0102790 | A1 | * | 5/2005 | Matsuno et al. | 15/326 |
| 2006/0236496 | A1 | * | 10/2006 | Oh et al. | 15/339 |
| 2007/0192986 | A1 | * | 8/2007 | Garcia et al. | 15/339 |

* cited by examiner

*Primary Examiner*—David B Thomas
(74) *Attorney, Agent, or Firm*—David W. Carstens; Carstens & Cahoon, LLP

(57) ABSTRACT

An apparatus for automatically cleaning dirt and debris from a pedestrian's footwear. The apparatus can be an integral portion of the entryway door's threshold or else can be made portable. The pedestrian steps upon a removable tray and activates a vacuum source. The vacuum source pulls the dirt and debris from the pedestrian's footwear through a multitude of openings in the removable tray. The dirt and debris is captured within the tray (large particles) and debris collection container (smaller particles) for later disposal. The apparatus cleans the welts and also provides a means for drying wet footwear. The apparatus can be either AC or DC powered and can be automated to only operate when a pedestrian is standing upon the tray, can operate continuously, or can be manually switched on and off.

17 Claims, 5 Drawing Sheets

DOOR THRESHOLD VACUUM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates generally to a novel vacuum system, and more specifically, to an apparatus for cleaning dust, dirt, and debris from the footwear of a pedestrian entering a building.

2. Description of Related Art

A variety of proposals have previously been made to control the tracking of dust, dirt, and debris caused by the footwear of a pedestrian entering a building. The most basic means is a doormat upon which the pedestrian wipes his or her shoes prior to entering. However, even when the shoes are relatively clean the doormat does little to remove and retain any debris and often contaminates the shoes of other pedestrians who may follow.

U.S. Pat. No. 4,024,599 (Gamboa) discloses an apparatus for cleaning the bottom of a wearer's shoes. The apparatus in Gamboa, a "Shoe Cleaning Machine" as illustrated in FIG. 1A, is a free-standing machine that has a platform upon which the wearer stands. Once activated, the machine physically scrubs debris from the wearer's shoes with bristles attached to a motorized belt while an integral fan carries the debris to a removable bag located in the housing. One of the drawbacks to Gamboa is that the machine is physically impractical for use in other than industrial settings. In addition, Gamboa utilizes a motorized belt with bristles that physically scrub a wearer's shoes, resulting in increased wear, maintenance and operating expense.

U.S. Pat. No. 4,027,355 (Mead et al.) discloses a pneumatic cleaning mat that provides positive cleaning action of a pedestrian's footwear. The mat in Mead et al. utilizes a pressurized tank of air that discharges through poppet valves located on the top surface of the mat when a pedestrian steps upon the mat. Thus, attached debris is blown away from the footwear. Because Mead et al. requires compressed air, its operation would likely result in debris being blown unpredictably about which could result in physical injury to a user. Also, the discharge of air would likely be noisy, making the device impractical for other than industrial settings. Maintenance of the poppet valves would likely be financially and physically burdensome, resulting in significant operating expense.

U.S. Pat. No. 4,551,879 (Ray) discloses an entrance dust arrester that vacuums the area directly under a door as it swings on its hinges. The vacuum in Ray, as illustrated in FIG. 4, is integral with the door, with the suction on the bottom of the door positioned such that it can vacuum the mat lying beneath. Thus, an individual who walks through the door and steps on the mat will leave debris on the mat which will be vacuumed upon closing the door. Ray requires a user to physically scrub their footwear on the mat beneath the door and then rely on the door to vacuum any debris away. Thus, if the user swings the door too quickly, the vacuum may be ineffective in cleaning the mat and the next individual to enter may end up tracking the debris that should have been previously captured. Also, this device requires extensive modification to an existing door which would increase installation, maintenance, and operating costs.

U.S. Pat. No. 6,067,688 (West) discloses a shoe cleaning device for scrubbing and vacuuming shoes. The device of West, as illustrated by FIG. 3, is either portable or else mounted in the floor of an entrance. Individuals entering would step on the device and wire bristles would physically scrub the individual's shoes. Debris would be carried away from the bristles by a powerful squirrel cage fan mounted directly beneath the top surface of the device. West requires significant space to house the internal components as disclosed. Thus, the physical size of the West device would make it impractical for use in other than industrial settings. Also, West requires both a squirrel cage fan and a vacuum source which increases expense and maintenance costs, further making it impractical for use in other than industrial settings.

Other prior proposals include footwear cleaning means utilized in semiconductor fabrication clean rooms such as the Sole Cleaner™ Automatic Contamination-Control Mat (illustrated by FIG. 2) and the Motorized Shoe Cleaner (illustrated by FIG. 1B), both offered by Terra Universal, Inc. The Sole Cleaner™ is similar to other clean room contamination-control offerings that utilize a mat with a sticky surface that physically adheres to debris on footwear. Prior to entering a clean room, the individual would walk across the sticky surface of the mat to remove debris from the bottom of his or her shoes. After a fixed number of uses, the sticky-mat surface must be changed. The Motorized Shoe Cleaner operates much the same as Gamboa in that it is a free-standing machine upon which an individual would step prior to entering a clean room. The Motorized Shoe Cleaner would then be activated to physically scrub debris from the individual's shoes and vacuum the debris away. Because of the increased number of components that wear and need to be replaced frequently, both of these devices require significant maintenance and operating expenditures that make them impractical for use in other than industrial settings.

Nothing in the prior art addresses the problems associated with providing a footwear cleaning means that is practical for use in an other than industrial setting. Therefore, a need exists for an improved footwear cleaning device that is suitable for use in residential, commercial, and industrial situations. Further, a need exists for an improved footwear cleaning device that is compact, quiet, and aesthetically attractive. And further, a need exists for an improved footwear cleaning device that requires relatively little maintenance and is inexpensive to operate. The present invention fills these needs and other needs as detailed more fully below.

BRIEF SUMMARY OF THE INVENTION

The present invention is directed to a footwear cleaning device or apparatus that can be used in residential, commercial, or even industrial settings. Prior art designs tend to require extensive modification to existing entryways or require large housings if used in a portable embodiment. Because of this, they tend to be impractical for use in other than industrial settings. The present invention is designed to overcome this problem and others by reducing the size, component count, and expense related to operation and maintenance.

Accordingly, it is one general object of the invention to provide a footwear cleaning device that can be easily installed in the threshold area of an existing doorway, or else made portable for use in a variety of situations.

It is another general object of the invention to provide a footwear cleaning device that minimizes the problem of excessive maintenance and expense associated with prior art devices by reducing the number of moving parts and eliminating excessive components that are designed to wear and require frequent replacement.

It is another general object of the invention is to provide a footwear cleaning device that efficiently cleans both the bottom and the welt of a shoe, and also dries the shoe if wet.

It is another general object of the invention is to provide a footwear cleaning device that is more aesthetically pleasing.

Yet another general object of the invention is to provide a footwear cleaning device that can be powered from either an AC or DC power source, thus lending to its flexibility and portability.

The invention accordingly comprises the features described more fully below, and the scope of the invention will be indicated in the claims. Further objects of the present invention will become apparent in the following detailed description read in light of the drawings.

BRIEF DESCRIPTION OF THE SEVERAL VIEWS OF THE DRAWING(S)

The novel features characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

Figure 1A:
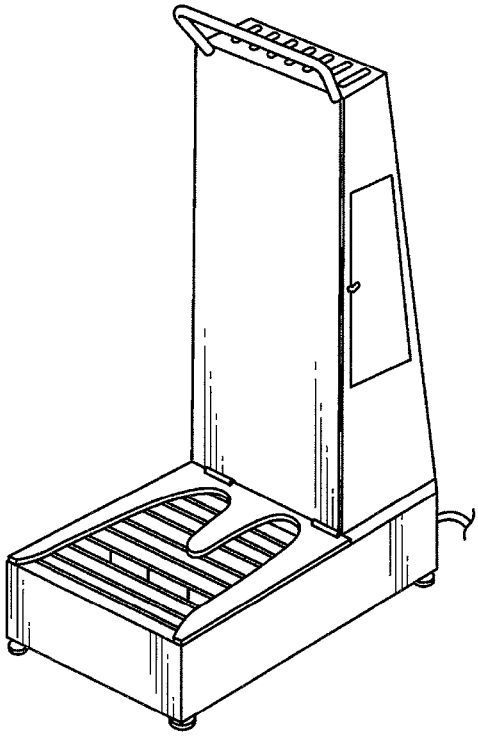
FIG. 1A (Prior Art)
FIG. 1A illustrates a perspective view of an embodiment of a prior art design for a motorized shoe cleaning machine.
Figure 1B:
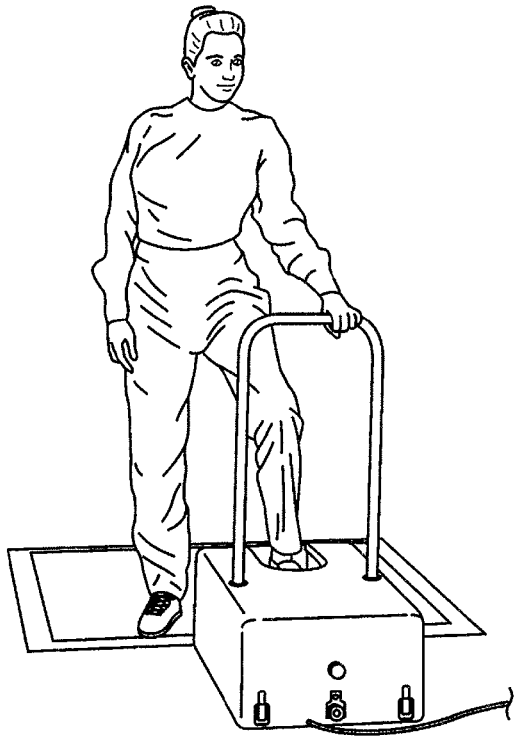
FIG. 1B (Prior Art)
FIG. 1B shows an embodiment of the prior art design of FIG. 1A being used by a clean room technician to clean her footwear prior to entering a workspace.
Figure 2:
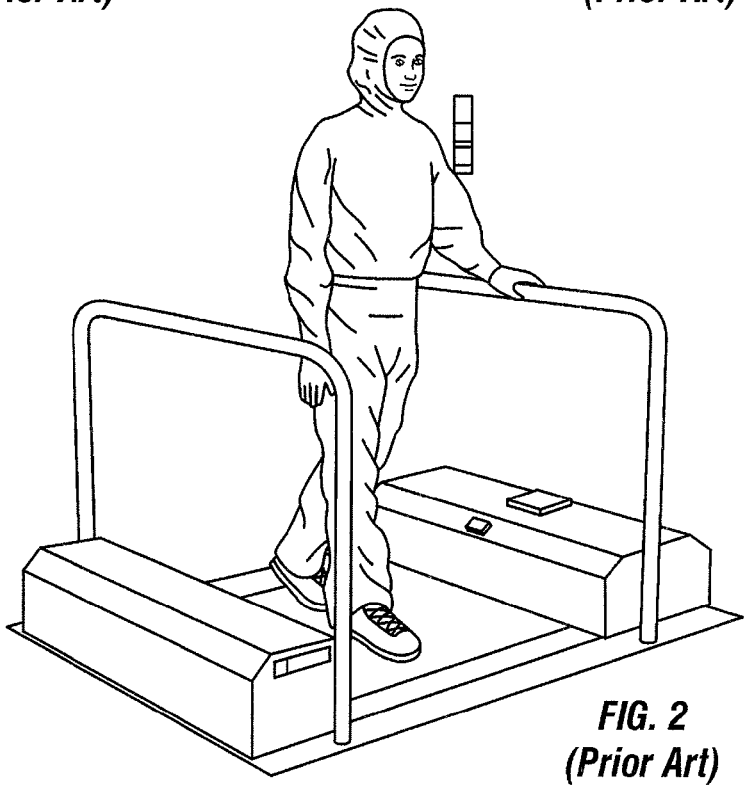
FIG. 2 (Prior Art)
FIG. 2 shows an embodiment of a prior art design for a sticky-mat being used by a clean room technician to clean her footwear prior to entering a workspace.
Figure 3:
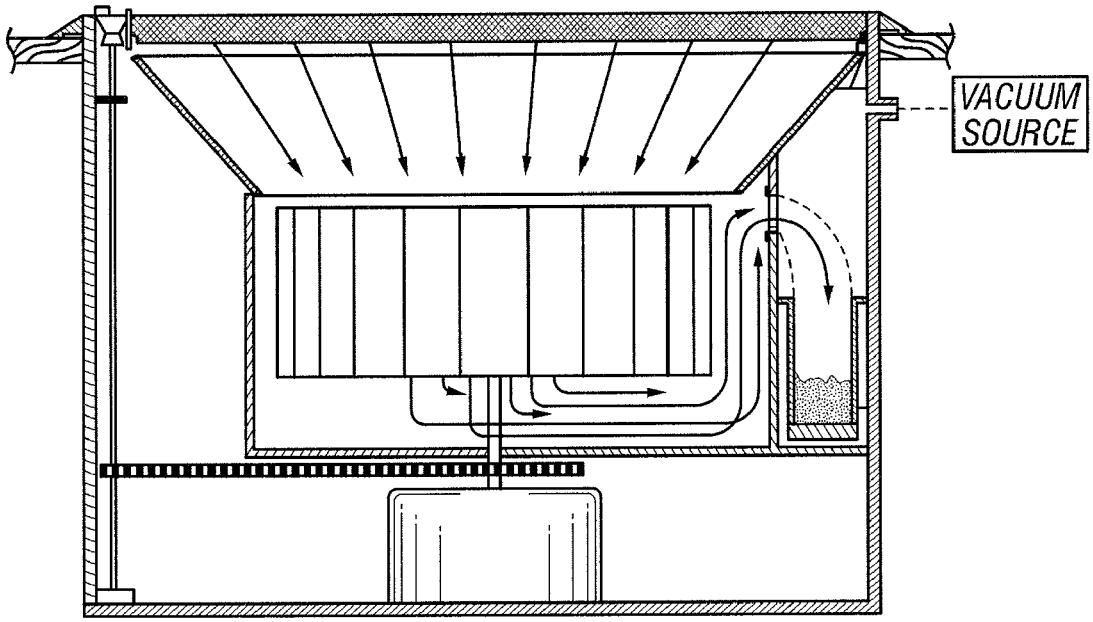
FIG. 3 (Prior Art)
FIG. 3 illustrates a frontal view of an embodiment of a prior art design for a shoe scrubbing and vacuuming device that utilizes a squirrel cage fan for debris removal in conjunction with a vacuum source.
Figure 4:
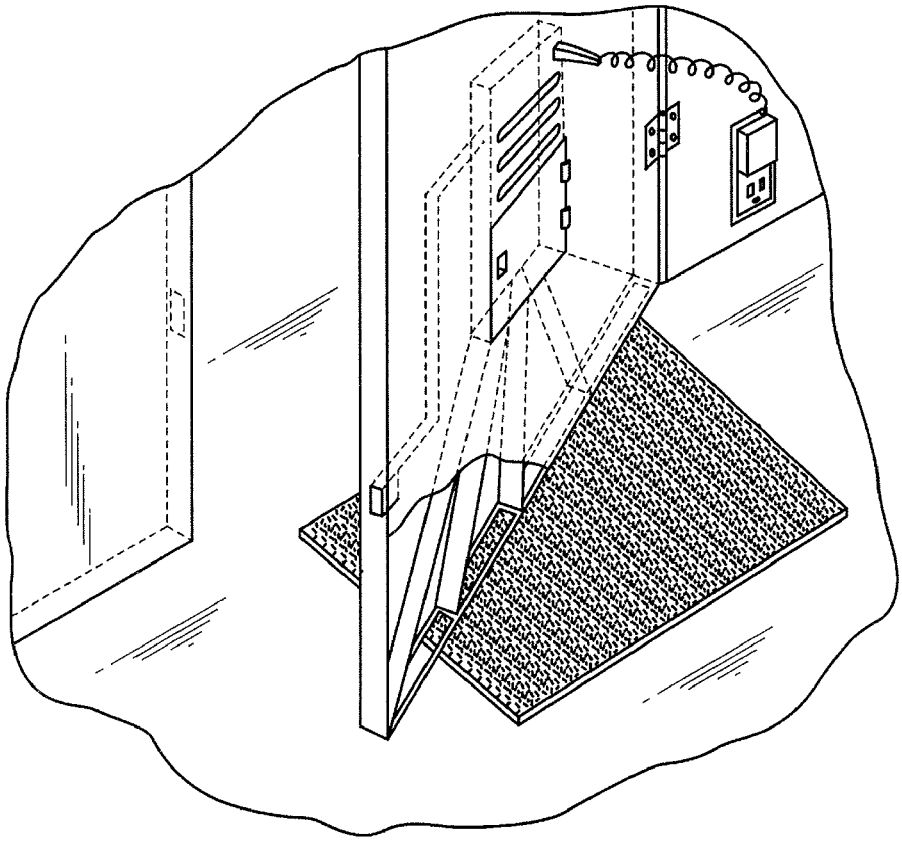
FIG. 4 (Prior Art)
FIG. 4 illustrates a perspective view of a prior art design for an entrance dust arrestor device that vacuums the mat beneath the door whenever the door is opened or closed.

Where used in the various figures of the drawing, the same reference numbers designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood.

REFERENCE NUMBERS

500 door threshold vacuum
502 tray
504 vacuum source
506 debris collection container
508 vacuum source controller
510 power switch
512 activation sensor
514 power source
516 access panel
518 vacuum port cover
520 vacuum port
522 doorsill plate
524 vacuum air discharge port
526 shoe welt vacuum port
528 AC outlet

DETAILED DESCRIPTION OF THE INVENTION

Referring now to the provided drawings, similar reference numbers represent the equivalent component throughout the several views of the drawings.

Figure 5A:
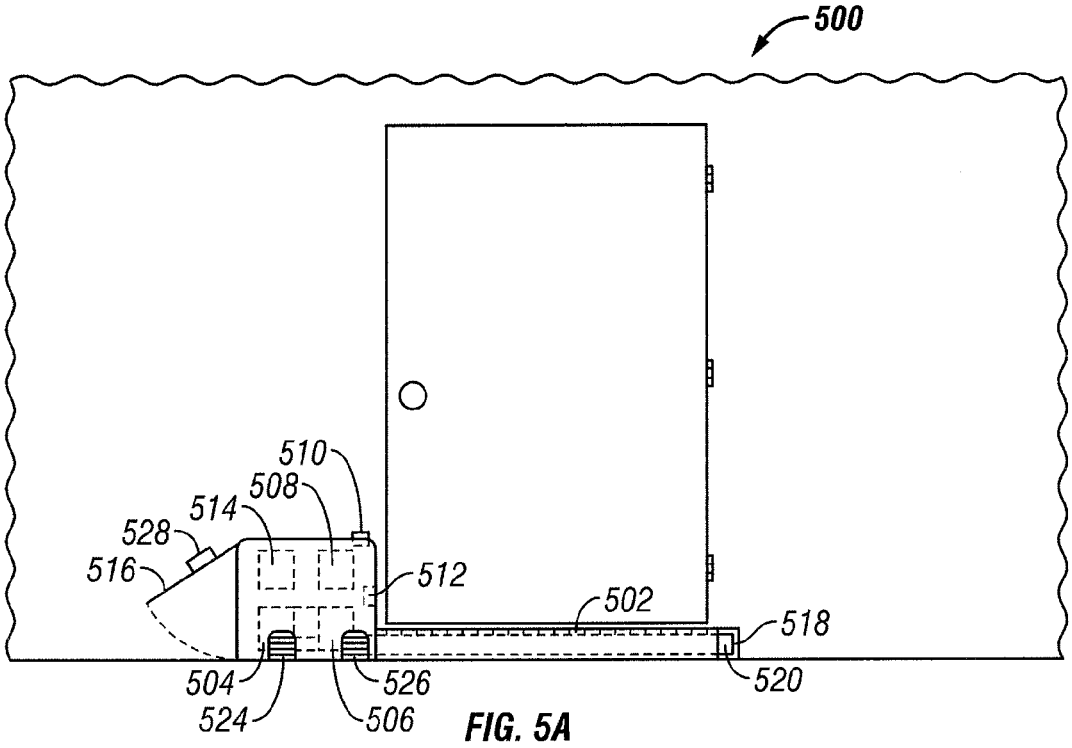
FIG. 5A illustrates a first embodiment of the present invention configured as an integral portion of a door threshold.
Figure 7A:
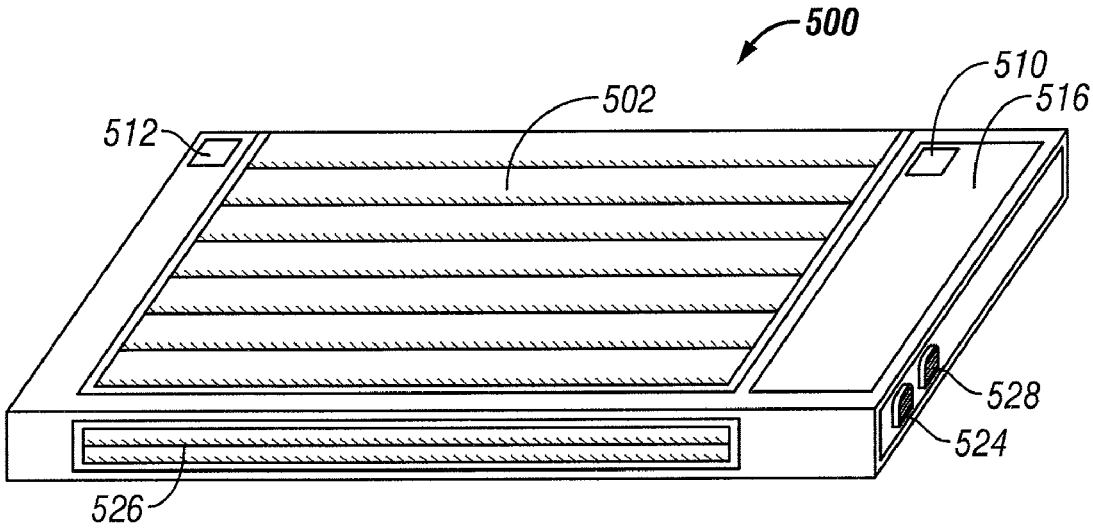
FIG. 7A illustrates a perspective view of a second embodiment of the present invention, configured as a portable door threshold vacuum device for residential or light commercial use.
Figure 7B:
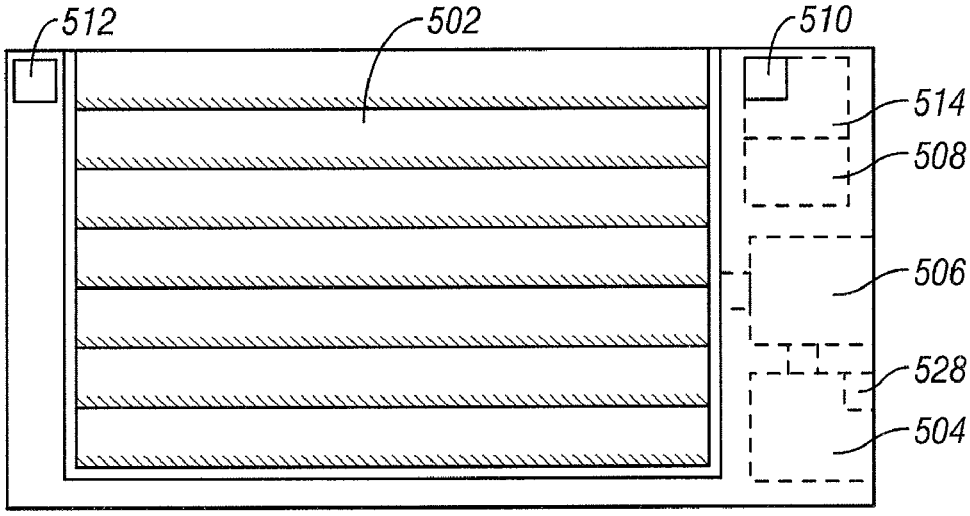
FIG. 7B illustrates a top down view of the second embodiment of FIG. 7A to further display the elements of the device.
Figure 7C:
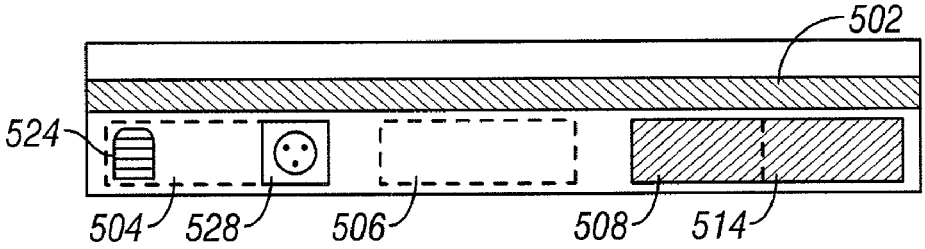
FIG. 7C illustrates a side view of the second embodiment of FIG. 7A to further display the elements of the device.
Figure 8:
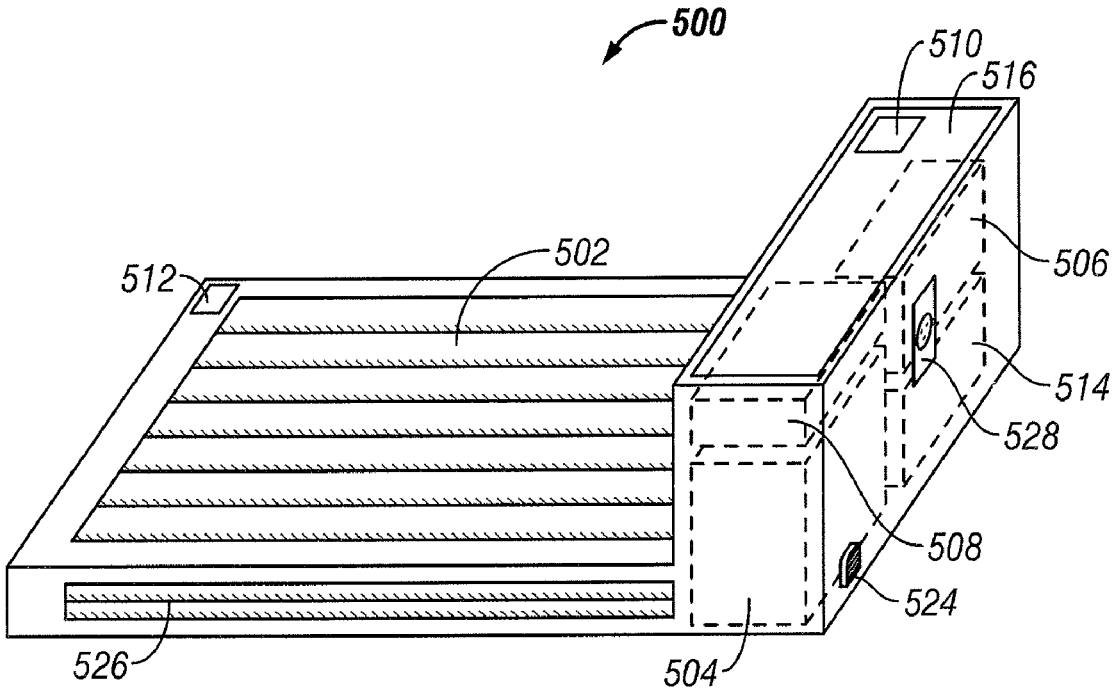
FIG. 8 illustrates a perspective view of a third embodiment of the present invention, configured as a portable door threshold vacuum device for commercial and industrial use.

FIG, 5 illustrates a first embodiment of a door threshold vacuum 500 as it would appear when mounted as an integral part of a door threshold. FIG. 5A illustrates how the embodiment of the device might appear to a pedestrian as they approach the door. As clearly shown, the threshold vacuum 500 features a frame upon which the removeable tray 502 rests. This frame is of low profile such that it does not require extensive modifications to the door or sill. Moreover, it does not require extensive modifications to the floor as do most prior art devices. Instead, the threshold vacuum 500 may be installed adjacent to the door opening. This installation may either be permanent (FIG. 5) or temporary (FIGS. 7 and 8).

Figure 5B:
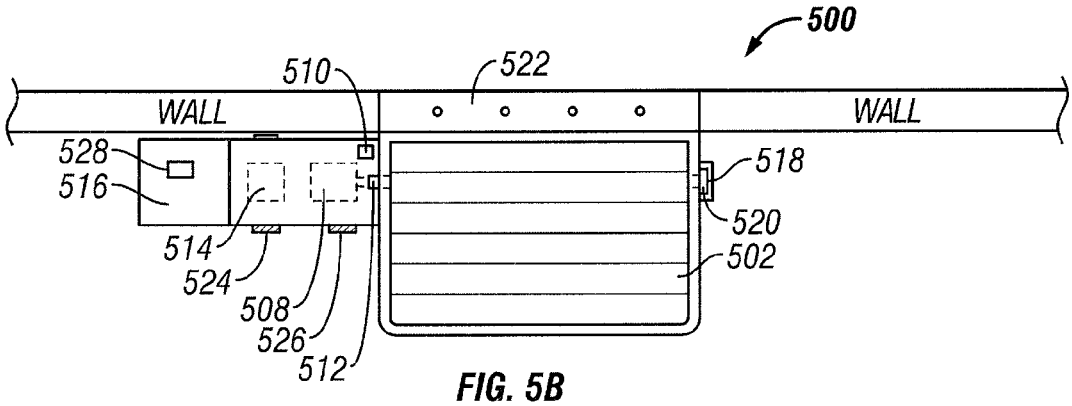
FIG. 5B illustrates a top down view of the first embodiment of FIG. 5A to further display the elements of the device.

FIG. 5B illustrates a top-down view of the embodiment to provide further detail of its elements. When the pedestrian opens the door and steps upon the removable tray 502, the door threshold vacuum 500 activates and pulls the dirt and debris from the bottom of the pedestrian's footwear. Thus, the dirt and debris are trapped within the apparatus, significantly reducing and possibly eliminating the amount of dirt and debris that is normally carried into a building upon the footwear of one who enters.

With reference to FIG. 5, the door threshold vacuum 500 apparatus illustrated in this first embodiment is an integral portion of the threshold of an entryway door. Because it is integral, the door threshold vacuum 500 includes a doorsill plate 522 that can be adjusted to maintain proper contact with the weather stripping typically present on the lower edge of an exterior door. On an interior door where there typically is no weather stripping, the doorsill plate 522 can be adjusted to prevent interference with the bottom of the door. Other embodiments may include a doorsill plate 522 that is fixed in order to reduce the number of components in manufacture.

The door threshold vacuum 500 includes a removable tray 502 upon which the pedestrian steps when entering the doorway. The tray 502 contains either a multitude of ridges or a raised tread pattern, with a multitude of openings through which the external air flows into the vacuum source 504. The vacuum source 504 can be any device, such as a fan or a vacuum pump, which creates a negative pressure differential that causes the flow of air from the multitude of openings in the tray 502 toward the vacuum source 504. While the vacuum source 504 is operating, the dirt and debris on the pedestrian's footwear is pulled into the bottom of the tray 502. Optional slight movement of the pedestrian's footwear while in contact with the tray 502 will also serve to dislodge dirt and debris trapped on the soles of the footwear. Most of the heavier dirt and debris is trapped within the bottom void spaces of the tray while the lighter dirt and debris is pulled through the multitude of openings and into the debris collection container 506 where it is trapped for later removal.

This first embodiment also includes a shoe welt vacuum port 526 that assists the pedestrian in cleaning the welts of the pedestrian's footwear. While the vacuum source 504 is energized, the air drawn through the shoe welt vacuum port 526 pulls the loose dirt and debris from the footwear's welt where it is trapped within the debris collection container 506. The pedestrian is required to alternately move his or her welts in front of the shoe welt vacuum port 526 while the vacuum source 504 is operating. In addition, the discharge air of the vacuum source 504 exits from the vacuum air discharge port 524 and can be used to dry the pedestrian's footwear if wet.

In a residential or light commercial setting where operating noise may be an issue, the door threshold vacuum 500 can easily be quieted. The housing containing the vacuum source 504 may be internally lined with a sound-deadening type of insulation such as: closed cell foam, polyurethane foam, melamine foam, cotton fiber, or glass fiber.

The first embodiment as illustrated in FIG. 5 utilizes an integral vacuum source 504 that is electrically powered. The power source 514 can be either AC (standard alternating current electrical service from an electrical utility provider) or DC (direct current such as from a battery) depending upon the requirements of the motor of the vacuum source 504. In the AC version, the power source could be wired into the AC electrical service of the building in which the door threshold vacuum 500 is installed. An additional AC outlet 528 can also be added to the access panel 516 to allow external AC devices to be plugged into the apparatus. In the DC version, the power source 514 would likely include a rechargeable battery and some type of recharging circuitry that could also be wired into the AC electrical service of the building in which the door threshold vacuum 500 is installed.

The first embodiment as illustrated in FIG. 5 utilizes a power switch 510 that allows operation of the door threshold vacuum 500. The power switch 510 can have two operating positions (on/off) or more, such as when an additional sensor is used to provide for automated use. A multiple position switch allows the apparatus to be switched completely off (such as for maintenance), completely on (such as for continuous operation), or placed in some intermediate position (such as for automatic operation).

This embodiment also employs an activation sensor 512 that detects when the door is operated, thus signaling the vacuum source controller 508 to energize the vacuum source 504 in preparation for capturing the dirt and debris on a pedestrian's footwear. The activation sensor 512 could be a mechanical limit switch, a photodetector, or some other type of device that can transform the stimulus of the door opening into a signal that allows the vacuum source controller 508 to operate. In another embodiment the activation sensor 512 could be triggered by the weight of the pedestrian stepping upon the tray 502. In still further embodiments, such as one designed for continuous operation, the activation sensor 512 may not be utilized and the vacuum source controller 508 may be controlled directly by the power switch 510.

This first embodiment of FIG. 5 generally requires very little maintenance. Dirt and debris from the pedestrian's footwear that is captured in the tray 502 is disposed of by removing the tray and either inverting it, vacuuming it with a household vacuum, or using a compressed air source to blow it clean. The debris collection container 506 is removed and cleaned by opening the access panel 516. Likewise, the vacuum source 504, vacuum source controller 508, and power source 514 can be accessed by opening the access panel 516.

The first embodiment of FIG. 5 is a universal design that allows the housing that contains the vacuum source 504 and its additional circuitry to be positioned on either the right or left sides of the tray 502. This will allow the door threshold vacuum 500 to be used with entryway doors regardless of which side of the door the hinges are located. Ideally, the housing will be located on the side opposite that of the door hinges, although this is not absolutely necessary. Thus, the door threshold vacuum 500 has a vacuum port 520 on either side; the housing is attached to one vacuum port 520 while the other unused vacuum port 520 is blocked with a vacuum port cover 518.

Figure 6:
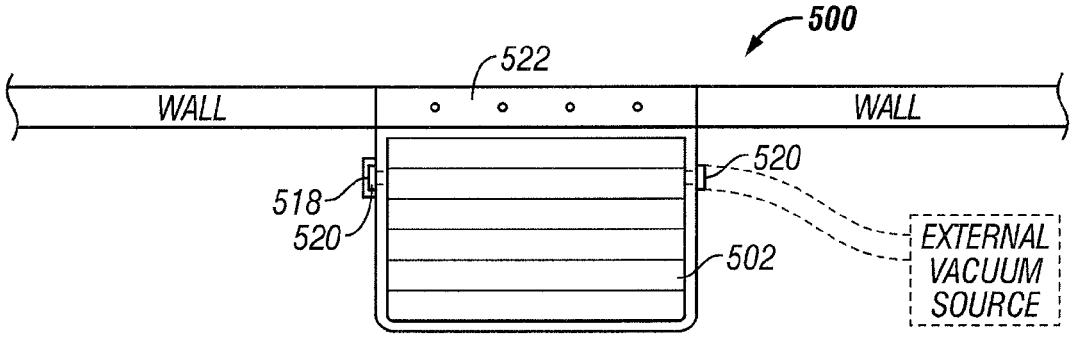
FIG. 6 illustrates a top down view of a variation on the first embodiment of FIG. 5 wherein the vacuum source is supplied externally.

FIG. 6 illustrates a variation on the first embodiment that utilizes an external vacuum source. In this variation, the entire housing that contains the vacuum source 504 and its additional circuitry is removed and the vacuum port 520 which was being utilized by the vacuum source 504 is blocked with a vacuum port cover 518. The external vacuum source is then coupled with the other vacuum port 520. This configuration can be used in homes or businesses that have, for instance, either a central vacuum system or some other vacuum source that is remotely located. As with the interchangeable housing, the external vacuum source may be connected to either vacuum port 520 depending upon the demands of the configuration.

FIG. 7 illustrates a second embodiment of the present invention, configured as a portable door threshold vacuum 500 device for residential or light commercial use. This second embodiment is designed to be more compact and low in profile so as to enhance its portability and aesthetic qualities. The access panel 516 covers the power source 514, debris collection container 506, and vacuum source 504. The power source 514 in this embodiment is ideally DC (such as a rechargeable battery), but can also be AC. In the AC configuration, it can either be plugged into a wall outlet or directly wired into the building's electrical supply. If AC powered, an additional AC outlet 528 is provided to power external devices.

The second embodiment of FIG. 7 utilizes a power switch 510 that can have either two positions (on/off) or more, such as when an additional sensor is used to provide for automated use. For instance, an activation sensor 512 may be incorporated to detect when a pedestrian is standing on the tray 502. The activation sensor 512 could be a photodetector, or some other type of device that can transform the stimulus of the pedestrian stepping onto the tray 502 into a signal that allows the vacuum source controller 508 to operate. In another embodiment the activation sensor 512 could be triggered by the weight of the pedestrian stepping upon the tray 502. In still further embodiments, such as one designed for continuous operation, the activation sensor 512 may not be utilized and the vacuum source controller 508 may be controlled directly by the power switch 510.

FIG. 8 illustrates a third embodiment of the present invention, configured as a portable door threshold vacuum device for commercial and industrial use. In this embodiment, it is likely that size will not be as much of an issue. Therefore, the internal components (power source 514, vacuum source controller 508, and vacuum source 504) may be of heavier grade for more strenuous and potentially continuous operation. Operation and maintenance of this embodiment would be similar to the lighter duty configuration as described above and illustrated in FIG. 7.

In view of the foregoing, the door threshold vacuum 500 serves needs not met by prior art devices. It can be used in residential, commercial, and even industrial settings to efficiently remove dirt and debris from a pedestrian's footwear. In addition, it does not require extensive modification to existing entryways in its permanent installation embodiment or else require large housings in a portable embodiment. Because of this, it is more practical for use in a wider variety of settings. Finally, its reduced size, component count, and expense related to operation and maintenance makes the proposed door threshold vacuum 500 a more efficient and cost effective means of capturing the dirt and debris from footwear so as to minimize wear and tear on the flooring of a building.

In addition to the use of a vacuum, the threshold vacuum device can also be outfitted with an electrostatic plate. It is accepted that dust is typically negatively charged. Therefore, an electrostatic plate could attract a portion of this dust or other negatively charged debris.

Further, the threshold vacuum device can include an ultraviolet light source to irradiate the user's shoes. The UV light kills a segment of the bacteria and viruses that are also present on the user's shoes. This is particularly important in view of concerns over virus pandemics such as the bird flu.

The terms and expressions employed herein have been used as terms of description and not of limitation. While specific embodiments of the invention have been disclosed, one of ordinary skill in the art will recognize that one can modify the dimensions and particulars of the embodiments without straying from the inventive concept. For example, the threshold vacuum, power, control circuitry, and housing could be completely mounted inside a wall such that no part of the device other than the tray upon which a user stands is visible. It will now be evident to those skilled in the art that there has been described herein an improved door threshold vacuum that provides significant improvements over existing shoe cleaning methods and devices.

I claim:

1. A threshold vacuum apparatus for cleaning footwear, the apparatus located adjacent to a door, the apparatus comprising:

a low profile frame having a tray on a top surface, the tray having a plurality of openings for accepting debris from a user's footwear, the frame creating a plenum;

a first port and a second port, wherein the first and second ports are affixed to the frame and open into the plenum;

a debris collection container, wherein the debris collection container is located outside the frame;

a vacuum source coupled to the plenum by the first port, wherein the vacuum source creates a low pressure that pulls debris from the footwear and transports it to the debris collection container; and a control means for controlling the operation of the vacuum source.

2. The apparatus of claim 1 wherein the second port provides a suction for vacuuming the sides of the footwear.

3. The apparatus of claim 1 further comprising a third port, wherein the air discharged front the third port is used to dry wet footwear.

4. The apparatus of claim 1 wherein the control means comprises a device selected from the group consisting of a photodetector, and a mechanical limit switch.

5. The apparatus of claim 1 wherein said vacuum source is an external vacuum cleaner.

6. The apparatus of claim 1 wherein said debris collection container utilizes a removable filter bag.

7. The apparatus of claim 1 further comprising a rechargeable DC battery for powering the vacuum source.

8. The apparatus of claim 1 further comprising an AC power source for powering the vacuum source.

9. The apparatus of claim 1 further comprising an external AC outlet.

10. The apparatus of claim 1 wherein the first and second ports are located on different sides of the frame.

11. The apparatus of claim 1 wherein the apparatus is permanently mounted in the threshold of the door.

12. The apparatus of claim 11 further comprising an adjustable doorsill.

13. The apparatus of claim 1 further comprising sound-deadening insulation, wherein the insulation is chosen from the group consisting of closed cell foam, polyurethane foam, melamine foam, cotton fiber, and glass fiber.

14. The threshold vacuum of claim 1 further comprising:

a UV light located within the frame for illuminating the bottom surface of the user's footwear.

15. The threshold vacuum of claim 1 further comprising:

an electrostatic plate located within the frame, wherein the tray imparts a first charge to the debris on the user's footwear and the electrostatic plate provides an opposite charge to attract the debris.

16. The threshold vacuum of claim 1 wherein the frame is sufficiently low profile to allow placement on existing floor surfaces.

17. The threshold vacuum of claim 1 wherein the vacuum source comprises an output air exhaust, and wherein the output air exhaust of the vacuum source is used to dry footwear located adjacent to the output.

* * * * *

UNITED STATES PATENT AND TRADEMARK OFFICE

CERTIFICATE OF CORRECTION

PATENT NO. : 7,472,452 B2
APPLICATION NO. : 11/420194
DATED : January 6, 2009
INVENTOR(S) : Junell It is certified that error appears in the above-identified patent and that said Letters Patent is hereby corrected as shown below:

Column 8, Claim 3, line 23, please delete “front” and insert --from-- therefor.

Signed and Sealed this

Nineteenth Day of May, 2009

JOHN DOLL
*Acting Director of the United States Patent and Trademark Office*